US008282479B2

(12) United States Patent
Sprinkle

(10) Patent No.: US 8,282,479 B2
(45) Date of Patent: Oct. 9, 2012

(54) GAMING MACHINE WITH SCREEN SPLIT AND MERGE FEATURE

(75) Inventor: Jason Todd Sprinkle, Pauline, SC (US)

(73) Assignee: Video Gaming Technologies, Inc., Franklin, TN (US)

( * ) Notice: Subject to any disclaimer, the term of this patent is extended or adjusted under 35 U.S.C. 154(b) by 13 days.

(21) Appl. No.: 13/021,060

(22) Filed: Feb. 4, 2011

(65) Prior Publication Data

US 2012/0202592 A1 Aug. 9, 2012

(51) Int. Cl.
*A63F 9/24* (2006.01)

(52) U.S. Cl. ..... 463/31; 463/16; 463/20

(58) Field of Classification Search ..... 463/31, 463/16, 20

See application file for complete search history.

(56) References Cited

U.S. PATENT DOCUMENTS 4,856,787 A * 8/1989 Itkis ..... 273/237
6,159,095 A * 12/2000 Frohm et al. ..... 463/19
7,708,633 B2 5/2010 Lind et al.
2007/0026936 A1 2/2007 Gatto et al.
2007/0099696 A1 5/2007 Nguyen et al.
2008/0026831 A1 1/2008 Wright et al.
2008/0176635 A1 7/2008 Randall
2008/0176644 A1 7/2008 Okada
2008/0254867 A1 10/2008 Fujimoto et al.
2009/0082082 A1 3/2009 Carr-Gregg et al.
2009/0291738 A1 11/2009 Visser
2010/0004054 A1 1/2010 Acres
2010/0048288 A1 2/2010 Canterbury et al.
2010/0210353 A1 8/2010 Gagner et al.

* cited by examiner

*Primary Examiner* — Omkar Deodhar
(74) *Attorney, Agent, or Firm* — Armstrong Teasdale LLP

(57) ABSTRACT

A gaming machine includes a display device and a processor coupled to the display device. The processor is configured to cause the display device to display a game using a first frame. The processor is also configured to divide the first frame into a plurality of second frames during play of the game in the first frame, cause the display device to display the plurality of second frames, and enable continued play of the game separately within each second frame. In addition, the processor is configured to merge the plurality of second frames into the first frame, cause the display device to display the first frame, and enable continued play of the game within the first frame.

32 Claims, 5 Drawing Sheets

GAMING MACHINE WITH SCREEN SPLIT AND MERGE FEATURE

BACKGROUND OF THE INVENTION

The embodiments described herein relate generally to gaming machines and, more particularly, to systems and methods for dividing a gaming machine display into a plurality of frames and merging the plurality of frames into a single frame.

At least some known gaming machines provide a plurality of concurrent games that are displayed on separate display screens or in separate portions of a display device. For example, at least some known gaming machines enable a player pre-select a desired number of games to play before a gaming session begins. However, the player cannot change the number of games during the gaming session to reduce the number of games being played. Rather, the player is required to exit the original multigame session to select a new desired number of games, select a new denomination, and then start play using of the multiple games.

Moreover, at least some known gaming machines enable a player to start a gaming session with multiple games, such as a number of simultaneously-played games including a primary game and one or more secondary games. During play on some such gaming machines, decisions made by the player during play of the primary game affect the one or more secondary games as well. However, at least some such gaming machines do not enable the player to merge the games into a single primary game on the fly.

Furthermore, at least some known gaming machines offer a secondary bonus game that is played within the rules of a primary game. For example, at least some known gaming machines instantiate a bonus game when a particular symbol combination is displayed on a payline during the primary game. The bonus game begins and the primary game is "held" until the bonus game ends. However, such bonus games require sequential play of the primary game and the bonus game and do not enable a player to independently operate either game.

BRIEF DESCRIPTION OF THE INVENTION

In one aspect, a gaming machine includes a display device and a processor coupled to the display device. The processor is configured to cause the display device to display a game using a first frame. The processor is also configured to divide the first frame into a plurality of second frames during play of the game in the first frame, cause the display device to display the plurality of second frames, and enable continued play of the game separately within each second frame. In addition, the processor is configured to merge the plurality of second frames into the first frame, cause the display device to display the first frame, and enable continued play of the game within the first frame.

In another aspect, a gaming system includes at least one gaming machine and a gaming server coupled to the gaming device via a network. The gaming machine includes a display device configured to display game play using a first frame and a plurality of second frames. The gaming server is configured to cause the display device to divide the first frame into the plurality of second frames during play of the game in the first frame, wherein each second frame separately enables continued play of the game. Moreover, the gaming server is configured to cause the display device to merge the plurality of second frames into the first frame during play of the game in the second frames, and enable continued play of the game within the first frame.

In another aspect, a method is provided for use with a gaming machine having a display device. The method includes displaying a game by the display device using a first frame, dividing the first frame into a plurality of second frames during play of the game in the first frame, and enabling continued play of the game separately within each second frame. The method also includes merging the plurality of second frames into the first frame and displaying the first frame by the display device, and enabling continued play of the game within the first frame.

DETAILED DESCRIPTION OF THE INVENTION

Exemplary embodiments of systems and methods for use in dividing a single gaming session into multiple gaming sessions on a gaming machine are described herein. The embodiments described herein enhance an entertainment aspect of the game, while not requiring additional wagers by a player. Moreover, the embodiments described herein provide the player with an element of control over his own destiny. Furthermore, the embodiments described herein facilitate changing the feel of game place by enabling the player to combine multiple gaming sessions into a single gaming session to multiply his bet. For example, embodiments of the systems and methods described herein enable a gaming machine to instantiate multiple gaming sessions that each operates within its own memory space. Wagered credits for each gaming session are drawn from a single purse, and any awards received based on winning outcomes are aggregated into the same single purse either continuously or until a player decides to merge the gaming sessions together or to cash out.

Exemplary technical effects of systems and methods described herein include at least one of: (a) displaying a game using a first frame; (b) dividing the first frame into a plurality of second frames during play of the game in the first frame; (c) enabling continued play of the game separately within each second frame; (d) merging the plurality of second frames into the first frame; and (e) enabling continued play of the game within the first frame.

Figure 1:
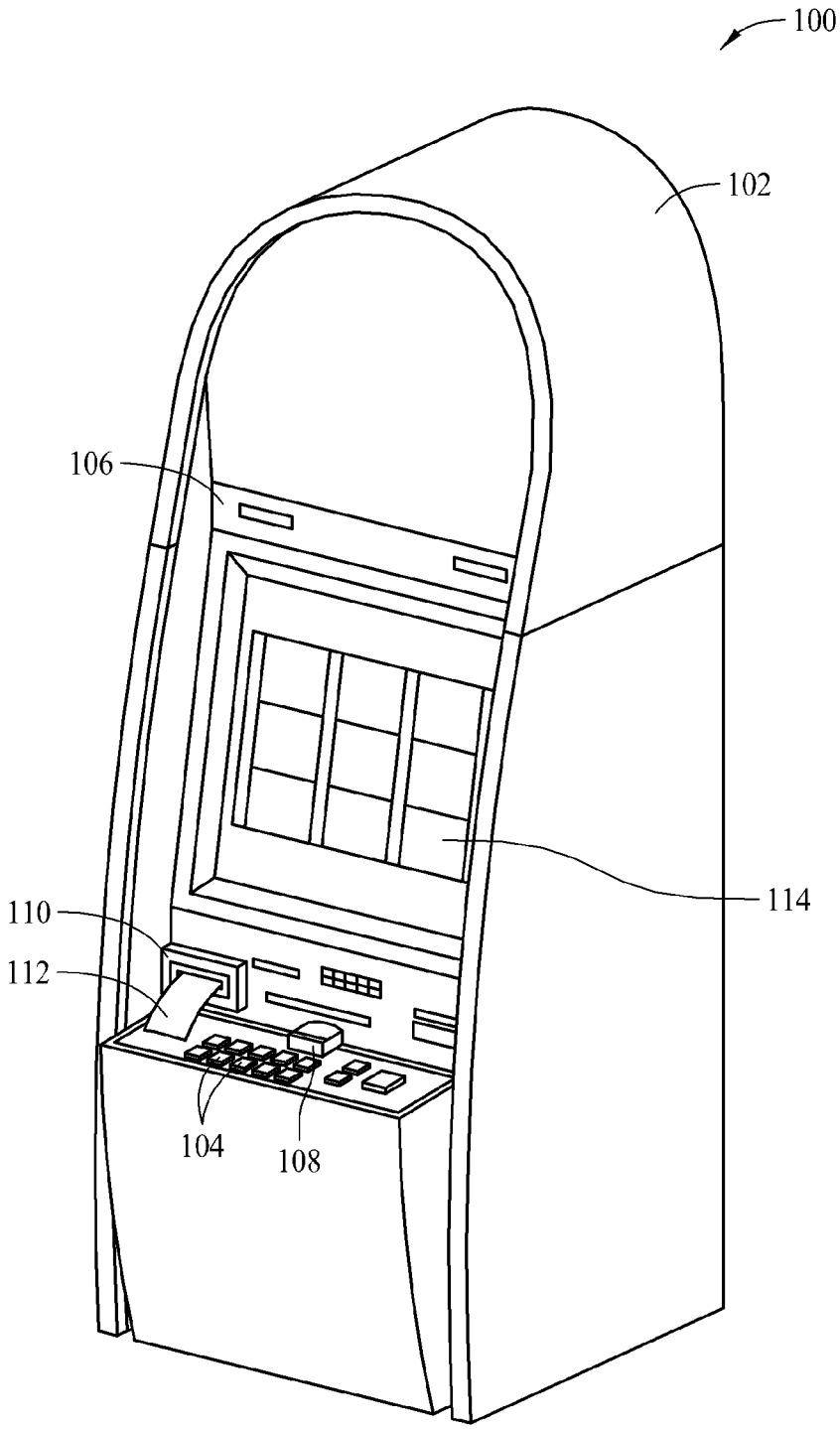
FIG. 1 is a schematic diagram of an exemplary gaming machine.

FIG. 1 is a schematic diagram of an exemplary gaming machine 100 that enables a player to split or divide a game in a first frame into a desired number of second frames that each enable continued play of the game. Gaming machine 100 may be any type of gaming machine, and may include, without limitation, different structures than those shown in FIG. 1.

Moreover, gaming machine 100 may employ different methods of operation than those described below.

In the exemplary embodiment, gaming machine 100 includes a cabinet 102 configured to house a plurality of components, such as a gaming machine controller, peripheral devices, display devices, and player interaction devices. For example, in an exemplary embodiment, gaming machine 100 includes a plurality of switches and/or buttons 104 that are coupled to a front 106 of cabinet 102. Buttons 104 may be used to start play of a primary or secondary game. One button 104 may be a "Bet One" button that enables the player to place a bet or to increase a bet. Another button 104 may be a "Bet Max" button that enables the player to bet a maximum permitted wager. Yet another button 104 may be a "Cash Out" button that enables the player to receive a cash payment or other suitable form of payment, such as a ticket or voucher, which corresponds to a number of remaining credits.

In the exemplary embodiment, gaming machine 100 also includes a coin acceptor 108 for accepting coins and/or tokens, and a bill acceptor 110 for accepting and/or validating cash bills, coupons, and/or ticket vouchers 112. Bill acceptor 110 may also be capable of printing tickets 112 as is described in greater detail below. Furthermore, in some embodiments, bill acceptor 110 includes a card reader or validator for use with credit cards, debit cards, identification cards, and/or smart cards. The cards accepted by bill acceptor 110 may include a magnetic strip and/or a preprogrammed microchip that includes a player's identification, credit totals, and any other relevant information that may be used. Moreover, in the exemplary embodiment, gaming machine 100 includes one or more display devices 114. Display devices 114 are mounted to cabinet 102, and may include a primary display device for displaying a primary game and a secondary display device for displaying a secondary or bonus game. Display devices 114 may include, without limitation, a plasma display, a liquid crystal display (LCD), and/or a display based on light emitting diodes (LEDs), organic light emitting diodes (OLEDs), polymer light emitting diodes (PLEDs), and/or surface-conduction electron emitters (SEDs). In an exemplary embodiment, display device 114 is used to display one or more game image, symbols and indicia such as a visual representation or exhibition of movement of an object such as a mechanical, virtual, or video reel, dynamic lighting, video images, and the like. In an alternative embodiment, display device 114 displays images and indicia using mechanical means. For example, display device 114 may include an electromechanical device, such as one or more rotatable reels, to display a plurality of game or other suitable images, symbols, or indicia.

In one embodiment, gaming machine 100 randomly generates game outcomes using probability data. For example, each game outcome is associated with one or more probability values that are used by gaming machine 100 to determine the game output to be displayed. Such a random calculation may be provided by a random number generator, such as a true random number generator, a pseudo-random number generator, or any other suitable randomization process.

Figure 2:
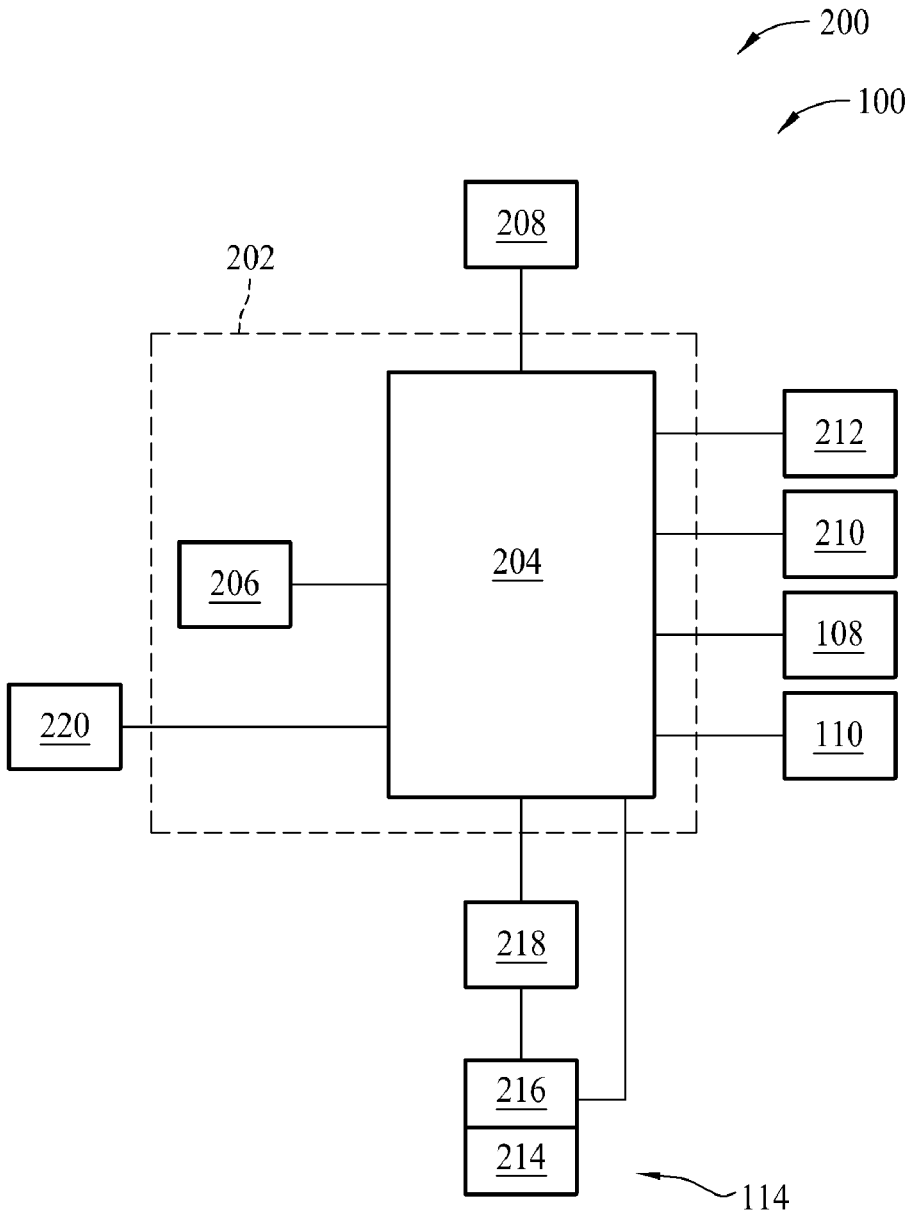
FIG. 2 is a schematic block diagram of an exemplary electrical architecture that may be used with the gaming machine shown in FIG. 1.

FIG. 2 is a schematic block diagram of an exemplary electrical architecture 200 that may be used with gaming machine 100. In the exemplary embodiment, gaming machine 100 includes a gaming machine controller 202 having a processor 204 communicatively coupled a memory area 206. Moreover, in the exemplary embodiment, processor 204 and memory area 206 reside within cabinet 102 (shown in FIG. 1) and may be collectively referred to herein as a "computer" or "controller." Controller 202 communicates with one or more other gaming machines 100 or other suitable devices via a network interface 208. Processor 204 may be a microprocessor, a microcontroller-based platform, a suitable integrated circuit, and/or one or more application-specific integrated circuits (ASICs). However, the above examples are exemplary only, and thus are not intended to limit in any way the definition and/or meaning of the term "processor."

Memory area 206 stores program code and instructions, executable by processor 204, for controlling gaming machine 100. For example, memory area 206 stores data such as image data, event data, player input data, random or pseudo-random number generation software, paytable data, and/or other information or applicable game rules that relate to game play on gaming machine 100. Moreover, memory area 206 may include one or more forms of memory. For example, memory area 206 can include random access memory (RAM), read-only memory (ROM), flash memory, and/or electrically erasable programmable read-only memory (EEPROM). In some embodiments, other suitable magnetic, optical, and/or semiconductor-based memory may be included in memory area 206 by itself or in combination.

In the exemplary embodiment, gaming machine 100 includes a credit display 210, which displays a player's current number of credits, cash, account balance or the equivalent. Gaming machine 100 also includes a bet display 212 which displays a player's amount wagered. Credit display 210 and bet display 212 may be standalone displays independent of display device 114, or credit display 210 and bet display 212 may be incorporated into display device 114. As described in additional detail below, display device 114 can display game play using a single frame, including a single credit display 210 and a single bet display 212. In addition, display device 114 can display game play using a plurality of frames by splitting or dividing the original, single frame. Each of the newly formed frames can include a respective credit display 210 and bet display 212. Moreover, as described in additional detail below, the credits associated with each of the multiple frames is drawn from the same available credit pool as the credit displayed on the original, single frame. Accordingly, credit display 210 and bet display 212 associated with the multiple frames operate substantially the same as credit display 210 and bet display 212 associated with the single frame.

Moreover, in an exemplary embodiment, display device 114 is controlled by controller 202. In some embodiments, display device 114 includes a touch screen 214 and an associated touch screen controller 216. A video controller 218 is communicatively coupled to controller 202 and touch screen controller 216 to enable a player to input game play decisions into gaming machine 100 via touch screen 214. Furthermore, gaming machine 100 includes one or more communication ports 220 that enable controller 202 to communicate with external peripheral devices (not shown) such as, but not limited to, external video sources, expansion buses, game or other displays, a SCSI port, or a key pad.

Figure 3:
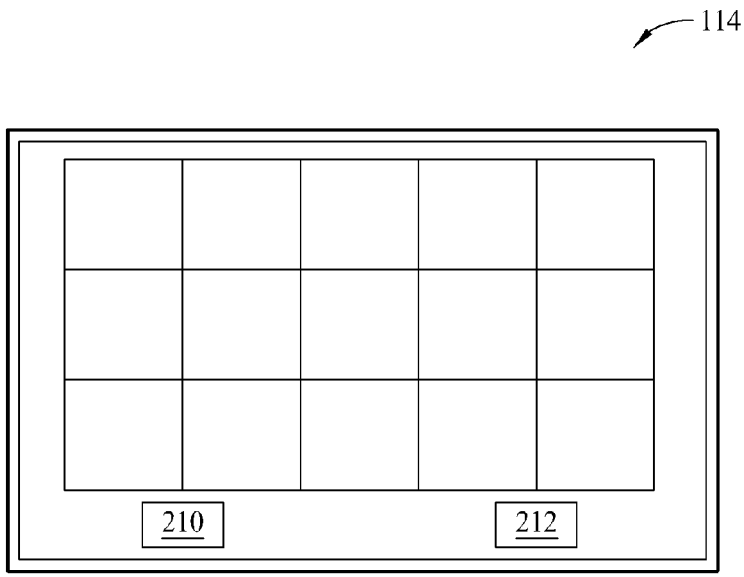
FIG. 3 is a view of an exemplary gaming machine display device during play of a game in a first frame.
Figure 4:
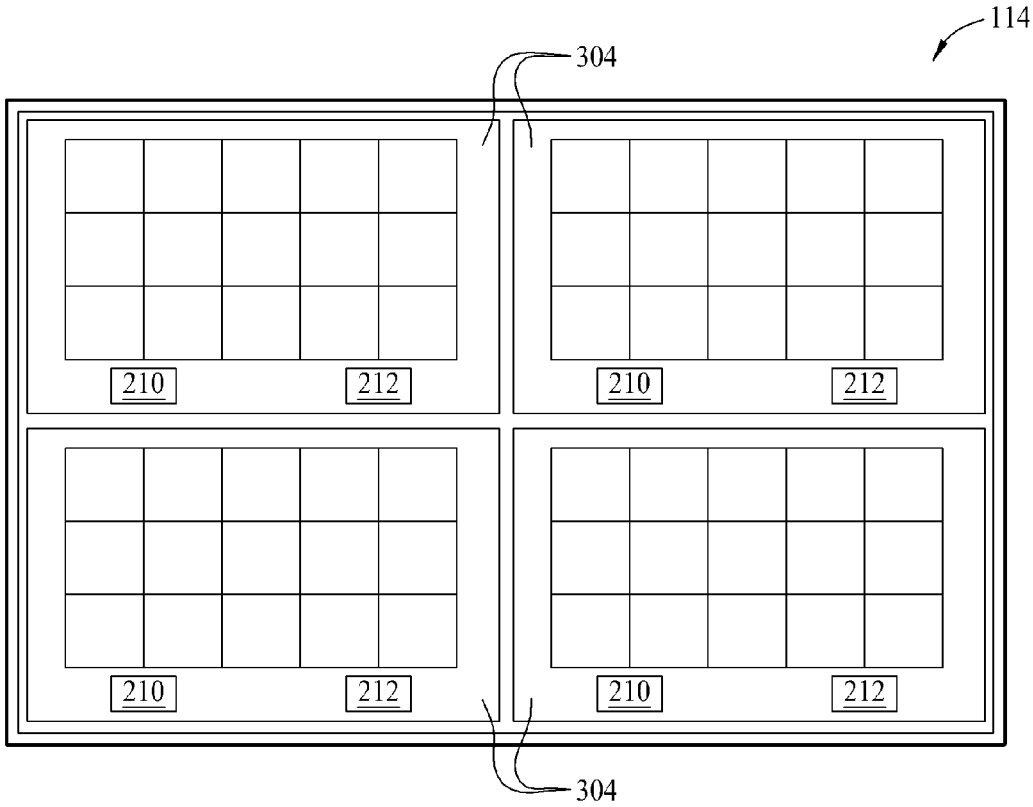
FIG. 4 is a view of an exemplary gaming machine display device during play of a game in a plurality of second frames.

FIG. 3 is a view of display device 114 during play of a game in a first frame 302. FIG. 4 is a view of display device 114 during play of the game in a plurality of second frames 304. As shown in both FIGS. 3 and 4, each frame 302 and 304 includes a respective credit display 210 and bet display 212. When the number of credits shown in credit displays 210 of second frames 304 is summed, the number is the same as the number of credits shown in credit display 210 of first frame 302. Accordingly, the number of credits available to a player for use in playing a game using only first frame 302 is divided between each second frame 304. In one embodiment, the player can divide first frame 302 into second frames 304 at any point during game play. For example, the player can designate the number of second frames 304 via, for example, touch screen 214 and/or buttons 104 (both shown in FIGS. 1 and 2). The player can also designate a desired wager for each second frame 304, and controller 202 will update bet displays 212 accordingly. In such an embodiment, the player may designate different proportions of available credits to each second frame bet display 212.

In an alternative embodiment, controller 202 detects a trigger condition during play of the game in first frame 302 and causes display device 114 to divide first frame 302 into second frames 304. For example, the type of trigger condition detected by controller 202 can determine the number of second frames 304. Alternatively, in response to the trigger condition, controller 202 prompts the player to input a decision to divide first frame 302 into second frames 304 and/or to input a number of second frames 304. In yet another embodiment, upon detection of a trigger condition, the division of first frame 302 into second frames 304 is carried out autonomously according to predefined parameters without involving a player's decision.

In another alternative embodiment, the player can select from a number of available games to play in each second frame 304. In some embodiments, each game uses a separate paytable stored in memory area 206 (shown in FIG. 2).

During operation, controller 202 causes display device 114 to display a game using first frame 302. During play of the game in first frame 302, controller 202 determines a game outcome, such as a first game outcome, and causes display device 114 to display the first outcome using first frame 302. Moreover, during play of the game in first frame 302, the player can input a command via, for example, touch screen 214 and/or buttons 104. In response to the command, controller 202 divides first frame 302 into second frames 304 and causes display device 114 to display second frames 304. Alternatively, controller 202 may detect a trigger condition during game play in first frame 302. In response to the trigger condition, such as a predefined game outcome, controller 202 divides first frame 302 into second frames 304 and causes display device 114 to display second frames 304. Moreover, in the exemplary embodiment, a number of available credits in credit display 210 are divided between credit displays 210 of second frames 304. The available credits may be evenly divided, may be divided according to player inputs, or may be divided according to one or more paytables or according to the trigger condition and predefined apportionment.

In the exemplary embodiment, controller 202 enables continued play of the game separately within each second frame 304. For example, controller 202 generates a respective game outcome, such as a second game outcome, for each second frame 304 independent of each other, such that no one game outcome depends on another game outcome. Alternatively, one or more game outcomes in second frames 304 may be dependent on each other. In the exemplary embodiment, controller 202 causes display device 114 to display a respective second outcome of the game using second frames 304. Any awards associated with a second game outcome are credited to credit display 210 of the same second frame 304.

In the exemplary embodiment, the player elects when to merge second frames 304 into first frame 302. For example, controller 202 merges second frames 304 into first frame 302 and causes display device 114 to display first frame 302. Moreover, controller 202 enables continued play of the game within first frame 302. When merging second frames 304 to form first frame 302, controller 202 merges or adds available credits shown by credit displays 210 of second frames 304, and displays the total number of available credits in credit display 210 of first frame 302. In addition, controller 202 merges or adds wagered credits shown by bet displays 212 of second frames 304, and displays the total number of wagered credits in bet display 212 of first frame 302. In some embodiments, a game available for play in first frame 302 after merging second frames 304 is the same game played in first frame 302 prior to being divided. Alternatively, a game available for play in first frame 302 after merging second frames 304 is different than the game played in first frame 302 prior to being divided.

Moreover, in some embodiments, the player may select a different number of frames, such as a plurality of third frames (not shown), to be formed by merging only a portion of second frames 304. For example, the player may select only two second frames 304 to merge into a single third frame while leaving a remaining two second frames 304 unmerged. Furthermore, in some embodiments, the player may further divide one or more second frames 304 into a plurality of separate third frames.

Figure 5:
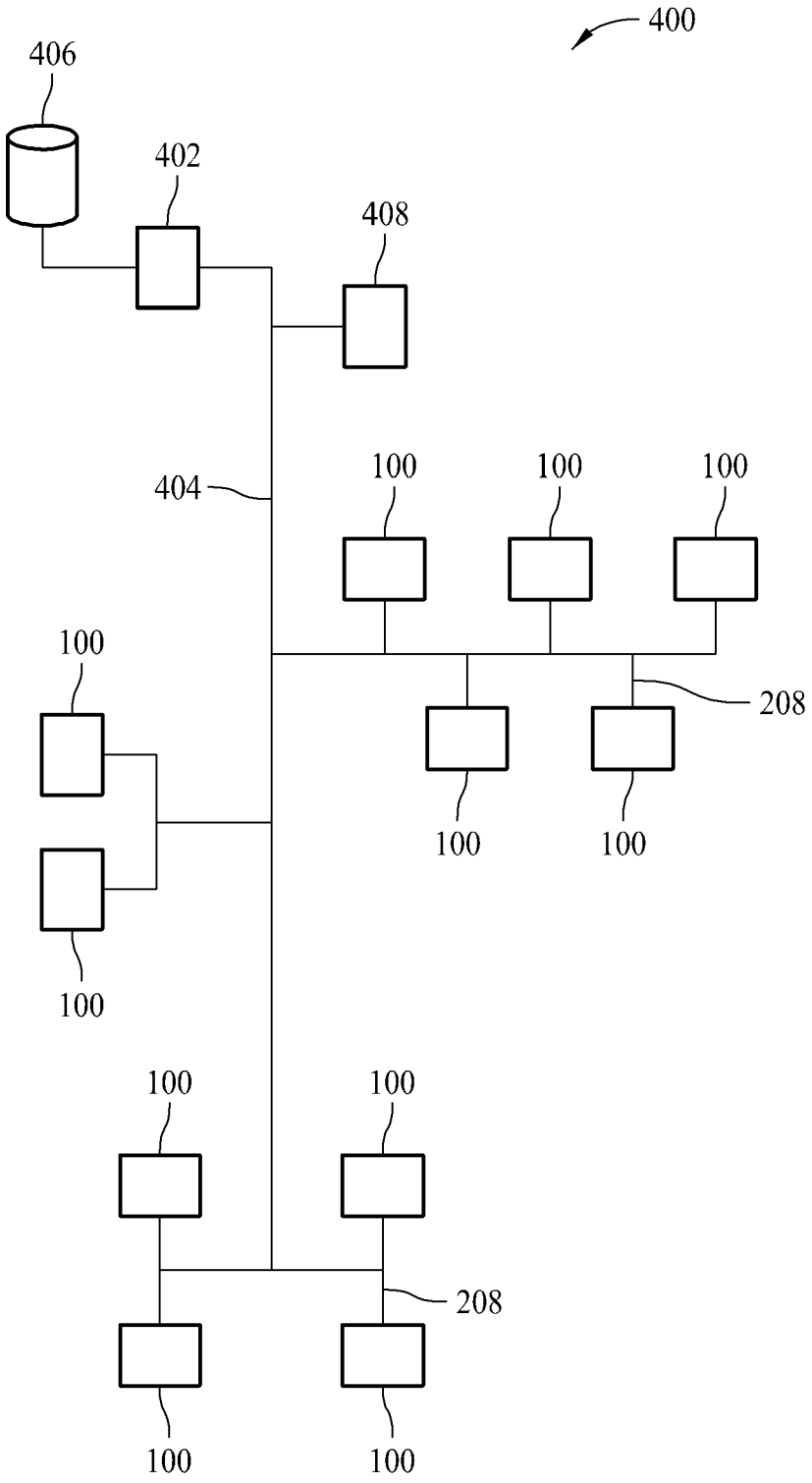
FIG. 5 is a block schematic diagram of an exemplary gaming system that includes a plurality of gaming machines shown in FIG. 1.

FIG. 5 is a block schematic diagram of an exemplary gaming system 400 that includes a plurality of gaming machines 100. Each gaming machine 100 is coupled via network interface 208 to one or more servers, such as a gaming server 402, using a network 404. Gaming server 404 includes a processor (not shown) that facilitates data communication between each gaming machine 100 and other components of gaming system 404. Such data is stored in, for example, a memory area 406, such as a database, that is coupled to gaming server 402.

As described above, gaming machines 100 may include video bingo machines, video poker machines, video slot machines, and/or other similar gaming machines that implement alternative games. Moreover, gaming machines 100 may be terminal-based machines, wherein the actual games, including random number generation and/or outcome determination, are performed at gaming server 402. In such an embodiment, gaming machine 100 displays results of the game via display device 114 (shown in FIGS. 1 and 2).

Moreover, in the exemplary embodiment, gaming system 400 includes a configuration workstation 408 that includes a user interface that enables an administrator to set up and/or to modify portions of gaming system 408 and/or gaming server 402. Gaming server 402 may perform a plurality of functions including, for example, game outcome generation, player tracking functions, and/or accounting functions. However, in alternative embodiments, gaming system 400 may include a plurality of servers that separately perform these functions and/or any suitable function for use in a network-based gaming system. In the exemplary embodiment, gaming server 402 controls bonus applications or bonus systems that award bonus opportunities on gaming system 400. Moreover, gaming server 402 includes a set of rules for awarding jackpots in excess of those established by winning pay tables (not shown) of each gaming machine 100. Some bonus awards may be awarded randomly, while other bonus awards may be made to groups of gaming machines 100 operating in a progressive jackpot mode.

Moreover, in some embodiments, gaming server 402 tracks data of players using gaming machines 100, and also controls messages that appear on display device 108 of gaming machines 100. For example, gaming server 402 can store physical characteristics of players, such as, but not limited to, the player age. Gaming server 402 can also store data related to the players and tracked using player tracking identification, such as a player card. Moreover, gaming server 402 can store information and data about the player such as loyalty points, player address, phone number, and/or any information that may be retrieved and transmitted to gaming machines 100. In some embodiments, gaming server 402 stores and tracks information such as, but not limited to, the average amount of wager played at gaming machine 100. Moreover, gaming server 402 can track an average amount of wagers by the player, any funds the player may have in an account, and data relating to reportable events. Such data is associated with individual players and logged using a taxable accrual log.

Furthermore, and in the exemplary embodiment, gaming server 402 is configured to enable a player to split or divide a game played in a single frame into a plurality of games played in a plurality of frames, as described above. For example, as described in additional detail below, gaming server 402 causes display device 114 to divide a first frame into a plurality of second frames during play of a game in the first frame, wherein each second frame separately enables continued play of the game. Moreover, gaming server 402 causes display device 114 to merge the plurality of second frames into the first frame during play of the game in the second frames and enables continued play of the game within the first frame.

Figure 6:
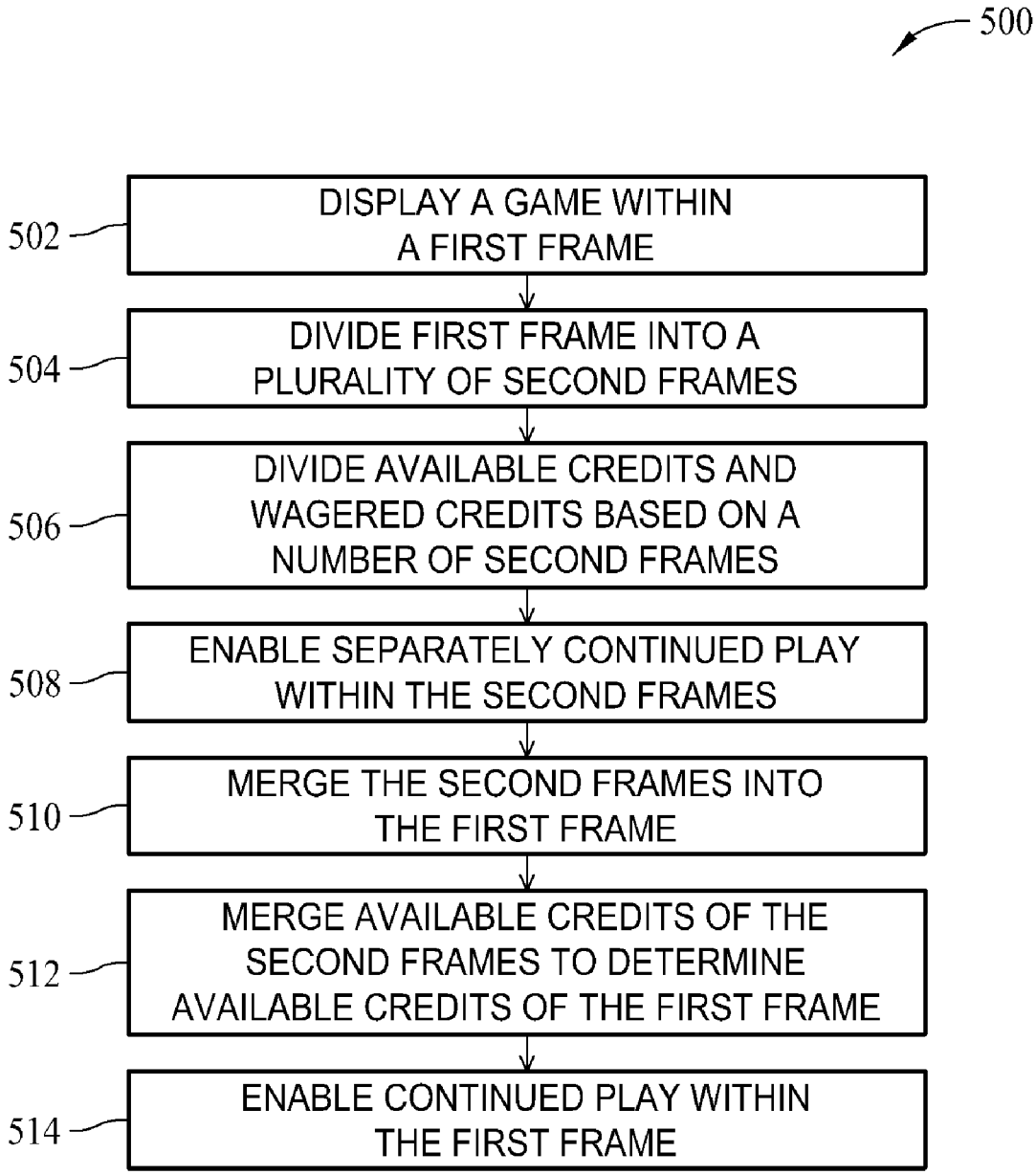
FIG. 6 is a flowchart that illustrates an exemplary method for dividing and/or merging frames during game play at the gaming machine shown in FIG. 1.

FIG. 6 is a flowchart 500 that illustrates an exemplary method for dividing and/or merging frames during game play at gaming machine 100 (shown in FIGS. 1 and 2). In the exemplary embodiment, controller 202 (shown in FIG. 2) displays 502 a game by at display device 114 (shown in FIGS. 1 and 2) using first frame 302 (shown in FIG. 3). Moreover, controller 202 displays credit display 210 and bet display 212 (both shown in FIGS. 2 and 3) using first frame 302. Alternatively, gaming server 402 (shown in FIG. 5) causes display device 114 to display 502 the game in first frame 302.

In the exemplary embodiment, and during play of the game in first frame 302, controller 202 or, alternatively, server 402, divides 504 first frame 302 into a plurality of second frames 304 and causes display device 114 to display second frames 304. In one embodiment, a player input prompts controller 202 or server 402 to divide first frame 302. In an alternative embodiment, controller 202 or server 402 detects a trigger condition and divides first frame 302 into second frames 304 according to the trigger condition. In another alternative embodiment, and in response to detecting a trigger condition, controller 202 or server 402 prompts the player to decide whether to divide first frame 302 into second frames 304. In some embodiments, the player can designate a number of second frames 304. In other embodiments, a trigger condition determines a number of second frames 304. In the exemplary embodiment, controller 202 or server 402 also divides 506 a number of available credits and displays each portion in a respective credit display 210 of second frames 304. Moreover, controller 202 or server 402 enables 508 separately continued play of the game within second frames 304. For example, each second frame 304 enables separate play of the game as if it were an independent gaming machine 100. Accordingly, controller 202 or server 402 executes code associated with each second frame 304 in an isolated thread, for example. As such, for each second frame 304, controller 202 or server 402 separately generates a game outcome. In an alternative embodiment, game outcomes for second frames 404 may be interdependent.

In the exemplary embodiment, and during play of the game in one or more second frames 304, controller 202 or server 402 merges 510 second frames 304 into first frame 302 and causes display device 114 to display first frame 302. In one embodiment, a player input prompts controller 202 or server 402 to merge second frames 304. In an alternative embodiment, controller 202 or server 402 detects a trigger condition and merges second frames 304 into first frames 302 according to the trigger condition. In another alternative embodiment, and in response to detecting a trigger condition, controller 202 or server 402 prompts the player to decide whether to merge second frames 304 into first frame 302. In the exemplary embodiment, controller 202 or server 402 also merges 512 the available credits in credit displays 210 of second frames 304 into credit display 210 of first frame 302. Controller 202 or server 402 also merges the wagered credits in bet displays 212 of second frames 304 into bet display 212 of first frame 302. Moreover, controller 202 or server 402 enables 514 continued play of the game within first frame 302.

Exemplary embodiments of systems and methods for providing a split and merge or unsplit feature on a gaming machine are described above in detail. The systems and methods are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

A computer, controller, or server, such as those described herein, includes at least one processor or processing unit and a system memory. The computer, controller, or server typically has at least some form of computer readable media. By way of example and not limitation, computer readable media include computer storage media and communication media. Computer storage media include volatile and nonvolatile, removable and non-removable media implemented in any method or technology for storage of information such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art are familiar with the modulated data signal, which has one or more of its characteristics set or changed in such a manner as to encode information in the signal. Combinations of any of the above are also included within the scope of computer readable media.

Although the present invention is described in connection with an exemplary gaming system environment, embodiments of the invention are operational with numerous other general purpose or special purpose gaming system environments or configurations. The gaming system environment is not intended to suggest any limitation as to the scope of use or functionality of any aspect of the invention. Moreover, the gaming system environment should not be interpreted as having any dependency or requirement relating to any one or combination of components illustrated in the exemplary operating environment.

Embodiments of the invention may be described in the general context of computer-executable instructions, such as program components or modules, executed by one or more computers or other devices. Aspects of the invention may be implemented with any number and organization of components or modules. For example, aspects of the invention are not limited to the specific computer-executable instructions or the specific components or modules illustrated in the figures and described herein. Alternative embodiments of the invention may include different computer-executable instructions or components having more or less functionality than illustrated and described herein.

The order of execution or performance of the operations in the embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, the term "database" refers generally to any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

When introducing elements of aspects of the invention or embodiments thereof, the articles "a," "an," "the," and "said" are intended to mean that there are one or more of the elements. The terms "comprising," including," and "having" are intended to be inclusive and mean that there may be additional elements other than the listed elements.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A gaming machine comprising;

a display device; and a processor coupled to said display device and configured to:

cause said display device to display a game using a first frame;

detect a trigger condition during play of the game in the first frame, divide the first frame into a plurality of second frames and cause said display device to display the plurality of second frames in response to the trigger condition;

enable continued play of the game separately within each second frame;

merge the plurality of second frames into the first frame and cause said display device to display the first frame; and enable continued play of the game within the first frame.

2. A gaming machine in accordance with claim 1, wherein said processor is configured to receive an input from a player and divide the first frame into the plurality of second frames in response to the input.

3. A gaming machine in accordance with claim 2, wherein said processor is configured to:

prompt the player for the input in response to the trigger condition.

4. A gaming machine in accordance with claim 1, wherein said processor is configured to divide a first wager into a plurality of second wagers according to a number of the plurality of second frames.

5. A gaming machine in accordance with claim 4, wherein a proportion of the first wager associated with each of the plurality of second wagers is configurable.

6. A gaming machine in accordance with claim 4, further comprising a first credit meter configured to store the first wager and a plurality of second credit meters, each second credit meter configured to store a respective second wager.

7. A gaming machine in accordance with claim 6, further comprising a memory area configured to store the first wager in association with said first credit meter and to store the second wager in association with each said second credit meter.

8. A gaming machine in accordance with claim 1, wherein said processor is configured to:

receive an input from a player indicating a desired number of the plurality of second frames; and divide the first frame into the indicated number of second frames.

9. A gaming machine in accordance with claim 1, wherein said processor is configured to generate a respective game outcome for each of the plurality of second frames.

10. A gaming machine in accordance with claim 1, wherein said processor is configured to:

cause said display device to display a first outcome of the game during play within the first frame; and cause said display device to display a respective second outcome of the game during play within each of the plurality of second frames.

11. A gaming machine in accordance with claim 1, wherein said processor is configured to merge the plurality of second wagers when merging the plurality of second frames into the first frame.

12. A gaming machine in accordance with claim 1, wherein said processor is configured to receive an input from a player and to merge the plurality of second frames into the first frame in response to the input.

13. A gaming machine in accordance with claim 1, wherein said processor is configured to merge the plurality of second frames into a plurality of third frames, a number of the plurality of third frames is less than a number of the plurality of second frames.

14. A gaming machine in accordance with claim 1, wherein said processor is configured to merge the plurality of second frames into a plurality of third frames, a number of the plurality of third frames is greater than a number of the plurality of second frames.

15. A gaming system comprising:

at least one gaming machine comprising a display device configured to display game play using a first frame and a plurality of second frames; and a gaming server coupled to said at least one gaming device via a network, said gaming server configured to:

detect a triggering condition during play of the game in the first frame, cause said display device to divide the first frame into the plurality of second frames in response to the triggering condition, wherein each second frame separately enables continued play of the game;

during play of the game in the second frames, cause said display device to merge the plurality of second frames into the first frame; and enable continued play of the game within the first frame.

16. A gaming system in accordance with claim 15, wherein said gaming server is configured to:

prompt a player for an input via said display device in response to the trigger condition;

receive the input from the player; and divide the first frame into the plurality of second frames in response to the input.

17. A gaming system in accordance with claim 15, wherein said gaming server is configured to divide a first wager into a plurality of second wagers according to a number of the plurality of second frames.

18. A gaming system in accordance with claim 17, wherein a proportion of the first wager associated with each of the plurality of second wagers is configurable.

19. A gaming system in accordance with claim 15, wherein said gaming server is configured to:

receive an input from a player via said at least one gaming machine, the input indicating a desired number of the plurality of second frames; and cause said display device to divide the first frame into the indicated number of second frames.

20. A gaming system in accordance with claim 15, wherein said gaming server is configured to generate a respective game outcome for each of the plurality of second frames.

21. A gaming system in accordance with claim 20, wherein said gaming server is configured to:

cause said display device to display a first outcome of the game during play within the first frame; and cause said display device to display a respective second outcome of the game during play within each of the plurality of second frames.

22. A gaming system in accordance with claim 15, wherein said gaming server is configured to merge the plurality of second wagers when merging the plurality of second frames into the first frame.

23. A gaming system in accordance with claim 15, wherein said gaming server is configured to receive an input from a player via said at least one gaming machine and to merge the plurality of second frames into the first frame in response to the input.

24. A method for use with a gaming machine having a display device, said method comprising:

displaying a game by the display device using a first frame;

detecting a triggering condition during play of the game in the first frame, dividing the first frame into a plurality of second frames in response to the triggering condition and displaying the plurality of second frames by the display device;

enabling continued play of the game separately within each second frame;

merging the plurality of second frames into the first frame and displaying the first frame by the display device; and enabling continued play of the game within the first frame.

25. A method in accordance with claim 24, further comprising receiving an input from a player and dividing the first frame into the plurality of second frames in response to the input.

26. A method in accordance with claim 25, further comprising:

prompting the player for the input in response to the trigger condition.

27. A method in accordance with claim 24, wherein dividing the first frame into a plurality of second frames comprises dividing a first wager into a plurality of second wagers according to a number of the plurality of second frames.

28. A method in accordance with claim 27, wherein merging the plurality of second frames into the first frame comprises merging the plurality of second wagers.

29. A method in accordance with claim 24, further comprising:

receiving an input from a player indicating a desired number of the plurality of second frames; and dividing the first frame into the indicated number of second frames.

30. A method in accordance with claim 24, further comprising generating a respective game outcome for each of the plurality of second frames.

31. A method in accordance with claim 30, further comprising:

displaying a first outcome of the game during play within the first frame; and displaying a respective second outcome of the game during play within each of the plurality of second frames.

32. A method in accordance with claim 24, further comprising receiving an input from a player and merging the plurality of second frames into the first frame in response to the input.

* * * * *